US007101148B2

(12) United States Patent
Görig et al.

(10) Patent No.: US 7,101,148 B2
(45) Date of Patent: Sep. 5, 2006

(54) DEVICE FOR USE IN A BLOWER CONFIGURATION

(75) Inventors: Diethard Görig, Mellrichstadt (DE); Thomas Seith, Bad Neustadt (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 201 days.

(21) Appl. No.: 10/816,373

(22) Filed: Apr. 1, 2004

(65) Prior Publication Data

US 2005/0074327 A1 Apr. 7, 2005

Related U.S. Application Data

(63) Continuation of application No. PCT/EP02/10754, filed on Sep. 24, 2002.

(30) Foreign Application Priority Data

Oct. 1, 2001 (DE) ..... 101 48 510

(51) Int. Cl.
*F04D 29/08* (2006.01)

(52) U.S. Cl. ..... 415/172.1; 415/174.3

(58) Field of Classification Search ..... 415/172.1, 415/173.1, 173.3, 173.4, 174.2, 174.3, 174.4, 415/170.1

See application file for complete search history.

(56) References Cited

U.S. PATENT DOCUMENTS 6,439,843 B1 * 8/2002 Finkenbinder ..... 415/172.1

FOREIGN PATENT DOCUMENTS

| | | |
|---|---|---|
| DE | 2 109 409 | 9/1972 |
| DE | 197 17 154 A1 | 10/1998 |
| DE | 198 55 905 A1 | 6/2000 |
| DE | 19855905 A1 * | 6/2000 |
| EP | 1 048 261 | 11/2000 |
| JP | 07208390 A | 8/1995 |

* cited by examiner

*Primary Examiner*—Edward K. Look
*Assistant Examiner*—Richard A. Edgar
(74) *Attorney, Agent, or Firm*—John T. Winburn; Russell W. Warnock; Craig J. Loest

(57) ABSTRACT

A device for application in a fan configuration is configured, in particular, to be directly driven by an electric motor. In the fan configuration, a centrifugal fan wheel is mounted to rotate in unison with a drive shaft. The centrifugal fan wheel, for producing a directed airflow, is surrounded by a fan housing. A seal is disposed in an admission orifice, for largely filling in an air gap between the centrifugal fan wheel and the inner surface of the fan housing. Such a configuration improves the housing and sealing thereof for an application in a vacuum cleaner by having the sealing device be embodied as a sealing ring linked to a buffer part out of the fan housing, which part tightly surrounds the admission orifice.

22 Claims, 3 Drawing Sheets

DEVICE FOR USE IN A BLOWER CONFIGURATION

CROSS-REFERENCE TO RELATED APPLICATION

This application is a continuation, under 35 U.S.C. § 120, of copending international application No. PCT/EP02/10754, filed Sep. 24, 2002, which designated the United States; this application also claims the priority, under 35 U.S.C. § 119, of German patent application No. 101 48 510.7, filed Oct. 1, 2001; the prior applications are herewith incorporated by reference in their entirety.

BACKGROUND OF THE INVENTION

Field of the Invention

The present invention relates to a device for use in a blower configuration, in particular, for use in a blower configuration for a household appliance, and to a blower configuration.

The term household appliance includes floor treating appliances and extractor hoods. Blower configurations which can be set over a wide output range are used in the household appliances referred to above by way of example.

German Published, Non-Prosecuted Patent Applications DE 21 09 409 A and DE 197 17 154 disclose blower configurations with an electric motor and a centrifugal blower wheel that is connected to a motor output shaft in a rotationally fixed manner. Including for the purpose of forming a directed air stream, the centrifugal blower wheel in such blower configurations is surrounded by a blower housing, which widens in a frusto-conical manner from an inflow opening to the motor drive. To reduce backflow losses, and accompanying losses in power of the blower configuration, a seal is disposed in the inflow opening for the purpose of largely filling an air gap between the centrifugal blower wheel and the inner side of the blower housing.

In particular, when such a blower configuration is installed in a floor-treating appliance, such as a vacuum cleaner, for example, with a high air output and highest possible suction force, further sealing problems nevertheless occur. These problems can be counteracted currently only by quite complicated fastening, fixing, and sealing measures, which require many individual parts and which have to be assembled in a production process that involves considerable labor time.

SUMMARY OF THE INVENTION

It is accordingly an object of the invention to provide a device for use in a blower configuration that overcomes the hereinafore-mentioned disadvantages of the heretofore-known devices of this general type and that is used in a vacuum cleaner with an improvement of the way in which it is received and sealed.

With the foregoing and other objects in view, there is provided, in accordance with the invention, a sealing structure for an inflow opening of a blower housing, the blower housing being associated with a centrifugal blower wheel, the centrifugal blower wheel and an inner side of the blower housing defining an air gap therebetween, the sealing structure including a sealing ring and a buffer part connected to the sealing ring, the buffer part shaped to surround the inflow opening of the blower housing in a sealing manner; and the sealing ring and the buffer part adapted to be disposed in the inflow opening to substantially fill the air gap between the centrifugal blower wheel and the inner side of the blower housing and to protrude from the blower housing.

With the objects of the invention in view, there is also provided blower configuration, including an electric motor, a drive shaft connected to the motor, a centrifugal blower wheel rotationally fixedly connected to the drive shaft, a blower housing having a inflow opening and an inner side and being configured to form a directed air stream, the blower housing surrounding the centrifugal blower wheel, the centrifugal blower wheel and the inner side of the blower housing defining an air gap therebetween, a seal having a sealing ring and a buffer part connected to the sealing ring and surrounding the inflow opening in a sealing manner, and the seal being disposed in the inflow opening and substantially filling the air gap between the centrifugal blower wheel and the inner side of the blower housing and protruding from the blower housing.

With the objects of the invention in view, in a blower configuration having an electric motor, a drive shaft connected to the motor, a centrifugal blower wheel rotationally fixedly connected to the drive shaft, and a blower housing having a inflow opening and an inner side and being configured to form a directed air stream, the blower housing surrounding the centrifugal blower wheel, the centrifugal blower wheel and the inner side of the blower housing defining an air gap therebetween, there is also provided a sealing structure including a sealing ring, a buffer part connected to the sealing ring, the buffer part shaped to surround the inflow opening of the blower housing in a sealing manner, and the sealing ring and the buffer part adapted to be disposed in the inflow opening to substantially fill the air gap between the centrifugal blower wheel and the inner side of the blower housing and to protrude from the blower housing.

A device according to the invention provides a seal formed as a sealing ring and the sealing ring, protruding from the blower housing, is connected to a buffer part, which surrounds the inflow opening in a sealing manner. Consequently, on one hand, a sealing ring that serves for sealing an air gap between a centrifugal blower wheel and an inner side of a blower housing continues to be disposed in the region of an inflow opening of the blower configuration. However, the sealing ring is formed such that it extends out of the blower housing and is connected to a buffer part that encloses the inflow opening as a bearing element. Consequently, according to the invention, there is, now, only one part, which is restricted to the region of the inflow opening of the blower configuration.

In accordance with another feature of the invention, an outer contour of the buffer part is adapted to an inner contour of an opening to be sealed. Consequently, the buffer part not only performs the task of bearing the blower configuration on one side but also the tasks of fixing and sealing the blower configuration in a given opening.

In accordance with a further feature of the invention, the material of the sealing ring is formed such that it is suitable for grinding in or slipping on by a centrifugal blower wheel when it is in an installed position on the blower housing. For details of this, reference is made to the disclosure of German Published, Non-Prosecuted Patent Application DE 197 17 154.

In accordance with an added feature of the invention, the material of the buffer part is elastic. It is, consequently, well suited for the aforementioned tasks of bearing, fixing, and sealing. In particular, the buffer part in this form does not have to be applied as a sealing compound that only cures when it is in situ on the blower housing.

In accordance with an additional feature of the invention, the buffer part is, advantageously, formed such that it tapers conically outside the inflow opening. The introduction of the blower configuration into a receptacle is made easier in this way.

In accordance with yet another feature of the invention, the sealing ring and the buffer part are formed as a one-piece body and also from one material. Such a configuration considerably reduces the expenditure involved in production and assembly. Installation is also simplified, as further described below, based upon an exemplary embodiment illustrated in the figures of the drawings. Accordingly, the one-piece combination of the sealing ring and buffer part is only referred to hereafter as the body.

In accordance with yet a further feature of the invention, the material of the body, preferably, has a hardness of about 40 to about 50 Shore. Furthermore, the body has a strength of about 10 to about 20 $N/mm^2$ and/or an elasticity of about 40 to about 60% and, preferably, allows an elongation of about 150 to about 300%. The material of the body is to be chosen, in particular, such that the aforementioned values are maintained even after ageing under the operating conditions in a floor-treating appliance, with continuous vibrational loading and elevated temperatures.

In accordance with a concomitant feature of the invention, the buffer part is provided with a clearance for setting an elasticity differing from that of the sealing ring. These clearances are, preferably, provided in the form of approximately equidistant blind holes in the buffer part.

A device according to the invention makes it possible for a blower configuration to be received more easily even in the confined space and difficult installation conditions in the interior of a floor-treating appliance. At the same time, while reducing the individual elements involved in the installation, a new seal is created between the blower housing or a blower shroud and the centrifugal blower wheel with optimization of the blower output data, in particular, with a reduction in the losses. The invention further explained below in an exemplary embodiment is distinguished, in particular, by the fact that separate components are not required for internal and external sealing. At the same time, a compensation that can be individually set for tolerances that always occur in production between fixed blower parts and rotating blower parts is provided. The bearing and simultaneous fixing of a device according to the invention by the buffer part also achieves significant noise damping. In such a case, material selection is possible in a wide range of parameters, the proposed construction measures permitting, in particular, a largely independent setting of the resilience of the sealing ring and of the buffer part.

Other features that are considered as characteristic for the invention are set forth in the appended claims.

Although the invention is illustrated and described herein as embodied in a device for use in a blower configuration, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
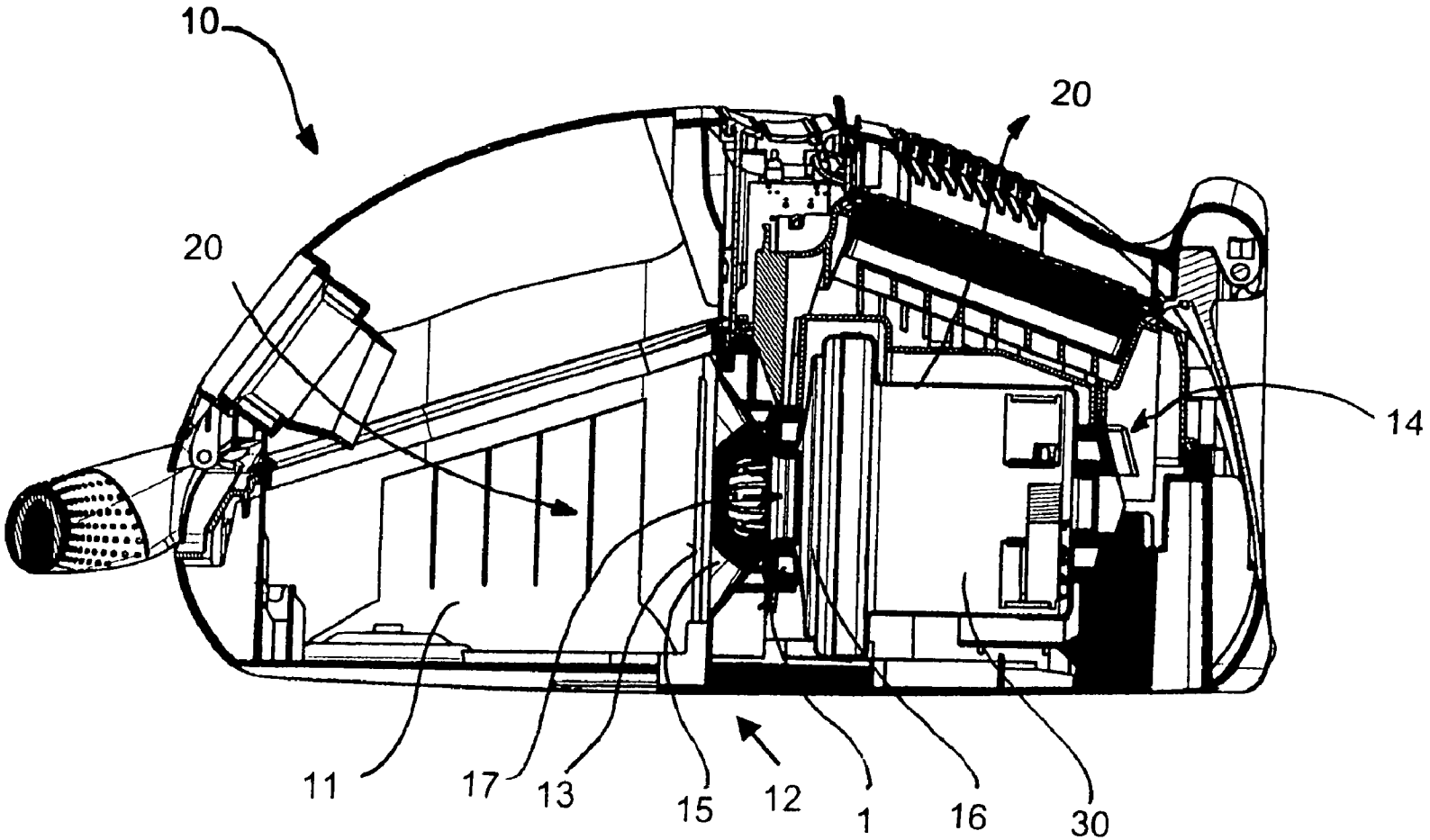
FIG. 1 is a cross-sectional view of a vacuum cleaner housing according to the invention along a longitudinal axis.

Referring now to the figures of the drawings in detail and first, particularly to FIG. 1 thereof, there is shown a sectional representation along a longitudinal axis of a vacuum cleaner housing 10, using a device 1 according to the invention. Following a drawn-in air stream 20, the vacuum cleaner housing 10 is subdivided into a suction chamber 11, which is divided by a dividing wall 12 with one or more filters 13 from a motor compartment 14. Provided in the dividing wall 12 is an air-directing funnel 15, as a space-saving and flow-optimized adaptation of the air stream 20 for transfer into a blower 16.

Figure 2:
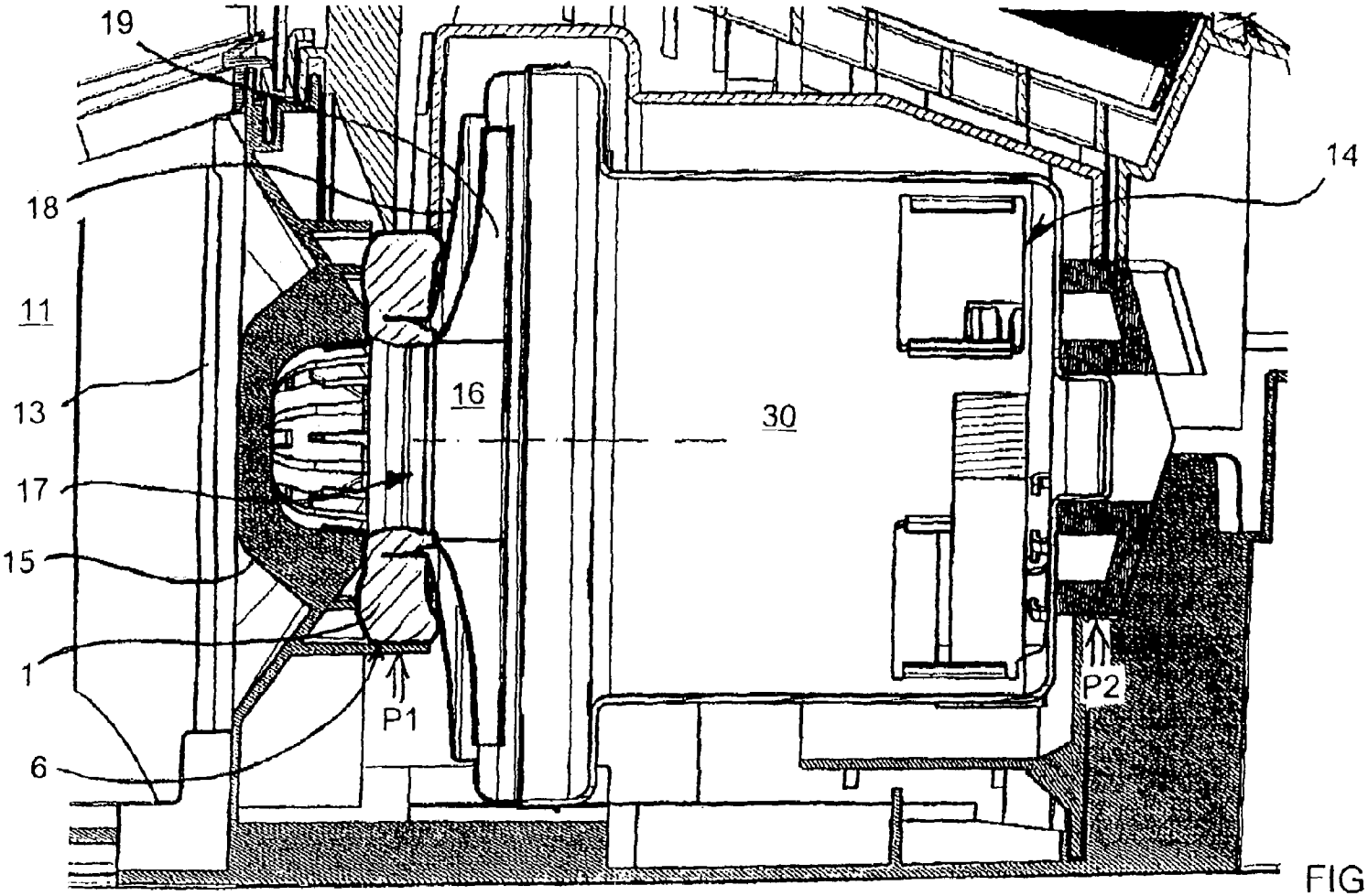
FIG. 2 is an enlarged cross-sectional view of a detail of the housing of FIG. 1.
Figure 5:
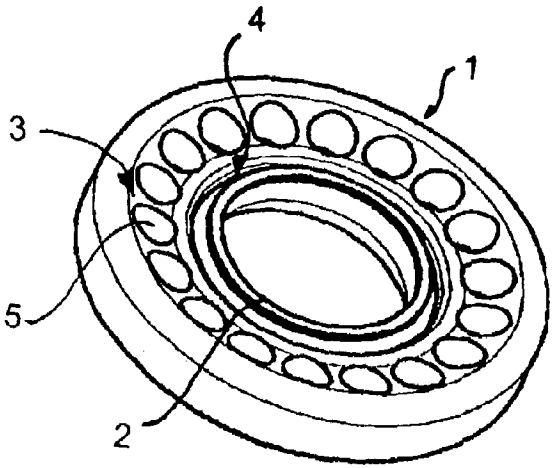
FIG. 5 is a perspective view of the body of FIG. 3.

Shown in the enlargement of a detail of FIG. 2 is a region around a motor 30 in the motor compartment 14. Identified by arrows P1 and P2 are two bearing locations of the motor 30 in the motor compartment 14 and in the air-directing funnel 15 of the dividing wall 12 and an opposite rear wall of the motor compartment 14. The form of a device according to the invention or a body 1, which serves as one of the two bearing locations, can be seen also in the cross-section of FIG. 2.

For fixing, the body 1 is disposed in the region of an inflow opening 17 such that it clamps on an edge region of a blower housing 18. In a boundary region between an end region of the blower housing 18 and a centrifugal blower wheel 19, the body 1 forms a sealing ring 2 in the inflow opening 17. Individual grinding-in or slipping on of the sealing ring 2 at the respective centrifugal blower wheel 19 has the effect that an optimized and largely vortex-free transition will take place from the suction region into an impeller, which optimizes the efficiency of the blower so configured.

The body 1, then, extends out of the inflow opening 17 and encloses the inflow opening 17 radially with the formation of a buffer part 3. Consequently, the body 1 is closed toward the dust compartment and is formed at an outer periphery 6 such that it is adapted to an inside diameter in the connecting region of the air-directing funnel 15. Consequently, the blower 16, with the motor 30 fixedly mounted on it, is disposed in a sealing manner with the air-directing funnel 15 and, consequently, at the dividing wall 12 toward the dust compartment 11.

Figure 3:
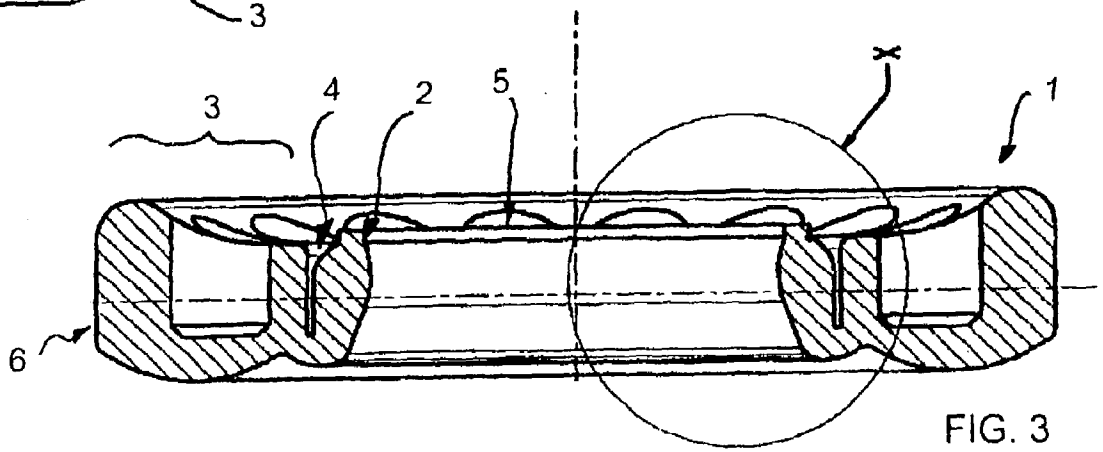
FIG. 3 is a cross-sectional view of a body according to the invention of FIGS. 1 and 2 including a sealing ring and a buffer.
Figure 4:
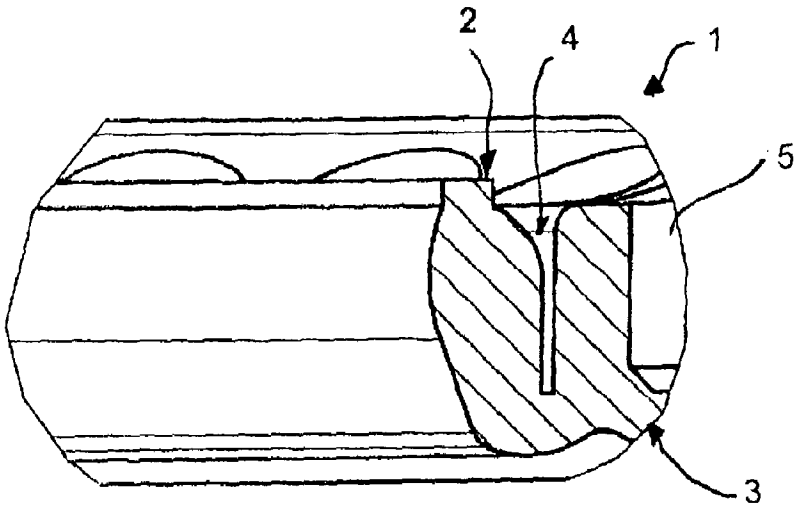
FIG. 4 is a fragmentary, cross-sectional view of an enlarged detail of the body of FIG. 3.

Thus, the body 1 represented in FIGS. 1, 2, 4 and 5 serves, at the same time, as a sealing ring 2 or as a seal between the blower housing 18 and the centrifugal blower wheel 19 and as a sealing bearing of the blower housing 18 at the dividing wall 12. The buffer part 3 serves to compensate for tolerances and, at the same time, reduces the noises occurring during operation. Moreover, vibrations and a tendency of the configuration including the blower 16 and the motor 30 to oscillate are reduced by appropriate adjustment of a, resilience of the material in the region of the buffer part 3. The measures taken for the setting and adjustment of the resilience of the buffer part 3 are shown in detail in the illustrations of FIGS. 3 to 5. For receiving the edge region of the blower housing 18 at the inflow opening 17, a radial incision 4 is provided. Clearances 5, formed here as blind holes, set the resilience of the material in the region of the buffer part 3.

With respect to material selection and other settings and parameters, reference is made to the introductory part of the description; considering all aspects, a rubber-like material is used with preference.

We claim:

1. A sealing structure for an inflow opening of a blower housing, the blower housing being associated with a centrifugal blower wheel, the centrifugal blower wheel and an inner side of the blower housing defining an air gap therebetween, the sealing structure comprising:

a sealing ring; and a buffer part connected to said sealing ring, said buffer part shaped to surround the inflow opening of the blower housing in a sealing manner; and said sealing ring and said buffer part adapted to be disposed in the inflow opening to substantially fill the air gap between the centrifugal blower wheel and the inner side of the blower housing and to protrude from the blower housing;

said sealing ring has a given elasticity; and said buffer part has a clearance setting an elasticity thereof to be different from said given elasticity.

2. The device according to claim 1, wherein said buffer part has an outer contour adapted to an inner contour of an opening to be sealed.

3. The device according to claim 1, wherein said sealing ring is of a material suitable for grinding in by the centrifugal blower wheel when said sealing ring is in an installed position on the blower housing.

4. The device according to claim 1, wherein said buffer part is of an elastic material.

5. The device according to claim 1, wherein said sealing ring and said buffer part are formed as a one-piece body and from one material.

6. The device according to claim 1, wherein said sealing ring and said buffer part are integral.

7. The device according to claim 1, wherein at least one of said sealing ring and said buffer part are of material having a hardness of between approximately 40 Shore and approximately 50 Shore.

8. The device according to claim 7, wherein said material maintains said hardness even after ageing under operating conditions in a floor-treating appliance with continuous vibrational loading and elevated temperatures.

9. The device according to claim 1, wherein at least one of said sealing ring and said buffer part are of material having a strength of between approximately 10 $N/mm^2$ and approximately 20 $N/mm^2$.

10. The device according to claim 9, wherein said material maintains said strength even after ageing under operating conditions in a floor-treating appliance with continuous vibrational loading and elevated temperatures.

11. The device according to claim 1, wherein at least one of said sealing ring and said buffer part are of material having an elasticity of between approximately 40% and approximately 60%.

12. The device according to claim 11, wherein said material maintains said elasticity even after ageing under operating conditions in a floor-treating appliance with continuous vibrational loading and elevated temperatures.

13. The device according to claim 1, wherein at least one of said sealing ring and said buffer part are of material that can elongate to between approximately 150% to approximately 300%.

14. The device according to claim 13, wherein said material maintains said elongatability even after ageing under operating conditions in a floor-treating appliance with continuous vibrational loading and elevated temperatures.

15. The device according to claim 1, wherein said clearance is a plurality of clearances in the form of approximately equidistant blind holes.

16. The device according to claim 1, wherein said sealing ring is of an elastic material and is to be slipped by the centrifugal blower wheel when said sealing ring is on the blower housing in an installed position.

17. A sealing structure for an inflow opening of a blower housing, the blower housing being associated with a centrifugal blower wheel, the centrifugal blower wheel and an inner side of the blower housing defining an air gap therebetween, the sealing structure comprising:

a sealing ring; and a buffer part connected to said sealing ring, said buffer part shaped to surround the inflow opening of the blower housing in a sealing manner; and said sealing ring and said buffer part adapted to be disposed in the inflow opening to substantially fill the air gap between the centrifugal blower wheel and the inner side of the blower housing and to protrude from the blower housing; and wherein said buffer part tapers conically at a portion to be disposed outside the inflow opening.

18. A vacuum cleaner comprising:

a housing enclosing a suction chamber and a motor compartment;

a dividing wall separating the suction chamber from the motor compartment and including an air-directing funnel;

an electric motor disposed within the motor compartment;

a centrifugal blower wheel rotationally driven by the motor;

a blower housing having a inflow opening and an inner side and being configured to form a directed air stream, said blower housing surrounding said centrifugal blower wheel, said centrifugal blower wheel and said inner side of said blower housing defining an air gap therebetween; and a seal body having an inner sealing ring surrounding the inflow opening and a buffer part extending radially outwardly from the sealing ring toward an outer periphery, the seal body forming a seal between the blower housing and the dividing wall and the seal body being disposed in the inflow opening and substantially filling said air gap between the centrifugal blower wheel and the inner side of said blower housing;

wherein the seal body is formed from an elastic material, the sealing ring having a first elasticity value, the buffer part having a second elasticity value being different than the first elasticity value.

19. The vacuum cleaner according to claim 18, wherein the sealing ring forms a bearing location at least partially supporting the motor and blower housing within the housing.

20. The vacuum cleaner according to claim 18, wherein the seal body includes a radial incision extending into the seal body in an axial direction between the sealing ring and the buffer part and receiving an edge of the blower housing.

21. The vacuum cleaner according to claim 18, wherein the buffer part includes a plurality of clearance recesses influencing the second elasticity value of the buffer part.

22. The vacuum cleaner according to claim 18, wherein the sealing ring and the buffer part are formed as a one-piece body from one material.

* * * * *